US006579192B2

(12) United States Patent
Sindelar et al.

(10) Patent No.: US 6,579,192 B2
(45) Date of Patent: Jun. 17, 2003

(54) SYSTEM AND FACILITY FOR EDUCATING STUDENTS CONCERNING THE GAME OF GOLF

(76) Inventors: Joseph L. Sindelar, 54 Hancock Dr., Horseheads, NY (US) 14845; Kristine Reuland, 125 Goff Rd., Corning, NY (US) 14830

( * ) Notice: Subject to any disclaimer, the term of this patent is extended or adjusted under 35 U.S.C. 154(b) by 0 days.

(21) Appl. No.: 09/846,275

(22) Filed: May 2, 2001

(65) Prior Publication Data

US 2002/0165036 A1 Nov. 7, 2002

(51) Int. Cl.[7] ..... A63B 69/36

(52) U.S. Cl. ..... 473/168; 273/DIG. 13; 473/193; 473/166

(58) Field of Search ..... 473/168–170, 473/150–156, 180, 193, 173–175, 179, 265; 273/DIG. 13

(56) References Cited

U.S. PATENT DOCUMENTS

| | | | | | |
|---|---|---|---|---|---|
| 720,406 | A | * | 2/1903 | Clifford | 473/265 |
| 1,864,030 | A | | 6/1932 | Ross | |
| 3,156,470 | A | * | 11/1964 | Newkirk | 473/169 |
| 3,584,877 | A | | 6/1971 | Florian | 273/176 FB |
| 3,620,536 | A | * | 11/1971 | Lau | 473/166 |
| 3,669,454 | A | * | 6/1972 | Kolonel | 473/162 |
| 3,843,136 | A | | 10/1974 | Buenzle | 273/176 F |
| 3,944,232 | A | | 3/1976 | Tierney | 273/176 FB |
| 3,990,708 | A | * | 11/1976 | Ingwersen | 473/153 |
| 4,244,576 | A | * | 1/1981 | Mosier et al. | 473/159 |
| 4,934,704 | A | | 6/1990 | Mazer | 273/176 F |
| 4,988,106 | A | * | 1/1991 | Coonrod | 473/160 |
| 5,112,054 | A | * | 5/1992 | Oswald | 473/156 |
| 5,316,302 | A | | 5/1994 | Sedberry | 273/87 C |
| 5,332,224 | A | * | 7/1994 | Libit et al. | 473/150 |
| 5,383,667 | A | | 1/1995 | Sheely | 273/181 R |
| 5,439,224 | A | * | 8/1995 | Bertoncino | 473/153 |
| 5,513,841 | A | * | 5/1996 | Takagi | 473/134 |
| 5,588,652 | A | * | 12/1996 | Lang | 473/168 |
| 5,707,300 | A | * | 1/1998 | May et al. | 473/257 |
| D407,458 | S | | 3/1999 | Soonlan | D21/792 |
| 6,322,455 | B1 | * | 11/2001 | Howey | 273/461 |

* cited by examiner

*Primary Examiner*—Mark S. Graham
(74) *Attorney, Agent, or Firm*—Welsh & Flaxman LLC

(57) ABSTRACT

An educational golf facility is provided in accordance with the present invention. The facility includes a target chipping zone, at least one inclined chipping/putting lane and a putting zone. The chipping/putting facility includes an extended surface having a striking area in front of which a student may swing a golf club and strike a golf ball. The facility further includes an inclined surface extending from the striking area. The inclined surface has long strand oriented such that balls struck up the inclined surface are caught and returned to the student; The striking area which includes an enclosure protecting students in the vicinity of the striking area. The enclosure includes a forward horizontal bar and a rear horizontal bar, wherein the forward horizontal bar is positioned to control the permissible back swing of a student utilizing the chipping/putting facility and the rear horizontal bar provides a safety area.

15 Claims, 7 Drawing Sheets

FIG.4

SCORECARD

| Stick to Golf | | Player 1 | Player 2 | | Player 3 | Player 4 |
|---|---|---|---|---|---|---|
| Yards | Par | Sue | | Hole# | | |
| 382 | 4 | 2 | | 1 | | |
| 395 | 4 | | | 2 | | |
| 342 | 4 | | | 1 | | |
| 122 | 3 | | | 4 | | |
| 465 | 5 | | | 5 | | |
| 363 | 4 | | | 6 | | |
| 150 | 3 | | | 7 | | |
| 379 | 4 | | | 8 | | |
| 423 | 4 | | | 9 | | |
| 3021 | 35 | | | OUT | | |
| 450 | 5 | | | 10 | | |
| 415 | 4 | | | 11 | | |
| 320 | 4 | | | 12 | | |
| 366 | 4 | | | 13 | | |
| 290 | 4 | | | 14 | | |
| 164 | 3 | | | 15 | | |
| 496 | 5 | | | 16 | | |
| 398 | 4 | | | 17 | | |
| 346 | 4 | | | 18 | | |
| 3245 | 37 | | | IN | | |
| 6266 | 72 | | | TOTAL | | |

36

SCORING SYMBOLS:

EAGLE -2 BIRDIE -1 BOGEY +1 DOUBLE BOGEY +2

FIG.5

SCORECARD SYMBOLS

Example: PAR 5 HOLE

EAGLE..... 3 -2

BIRDIE..... 4 -1

PAR..... 0

BOGEY..... 6 +1

DOUBLE BOGEY... 7 +2

SYSTEM AND FACILITY FOR EDUCATING STUDENTS CONCERNING THE GAME OF GOLF

BACKGROUND OF THE INVENTION

1. Field of the Invention

The invention relates to an educational golf system. More particularly, the invention relates to an educational golf system incorporating a series of stations training students in various aspects of the game of golf.

2. Description of the Prior Art

The game of golf has increased in popularity tremendously over the past ten years. However, most children are still not exposed to the game of golf, unless a parent undertakes to teach a child the game.

Schools attempt to exposed children to the golf, but are generally limited to permitting children to swing a golf club and possibly hit a few wiffle balls around the playing field. Even when schools attempt to teach children at this very minimal level, the mere fact that one child is swinging a club presents a serious hazard. As such, and in view of the minimal benefit obtained from such an unstructured teaching environment, most schools have never added, or removed after trying, golf from the physical education curriculum.

As such, those individuals who enjoy the game of golf and those educators appreciating the educational value associated with teaching the game of golf desire a system and facility which may be used to teach students the game of golf in a controlled and enjoyable environment. The present invention provides such a system and facility.

SUMMARY OF THE INVENTION

It is, therefore, an object of the present invention to provide an educational golf facility including a target chipping zone, at least one inclined chipping/putting lane and a putting zone.

It is also an object of the present invention to provide a chipping/putting facility. The chipping/putting facility includes an extended surface having a striking area in front of which a student may swing a golf club and strike a golf ball. The facility further includes an inclined surface extending from the striking area. The inclined surface is oriented such that balls struck up the inclined surface return to the student standing in the striking area.

It is a further object of the present invention to provide a chipping/putting facility having a striking area which includes an enclosure protecting students in the vicinity of the striking area. The enclosure includes a forward horizontal bar and a rear horizontal bar, wherein the forward horizontal bar is positioned to control the permissible back swing of a student utilizing the chipping/putting facility and the rear horizontal bar is positioned to keep other students from getting too close to those students using the chipping putting facility.

It is another object of the present invention to provide a system for teaching students the game of golf. The system includes a plurality of stations where students may perform different golf shots. Each station includes targets associated with preassigned scores directly related to traditional scoring techniques used in the game of golf. The system also includes the use of score cards upon which student write scores awarded as they participate at the plurality of stations.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a score card used in accordance with the present invention.

FIG. 5 is a chart showing the traditional scoring and symbols used in the game of golf.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
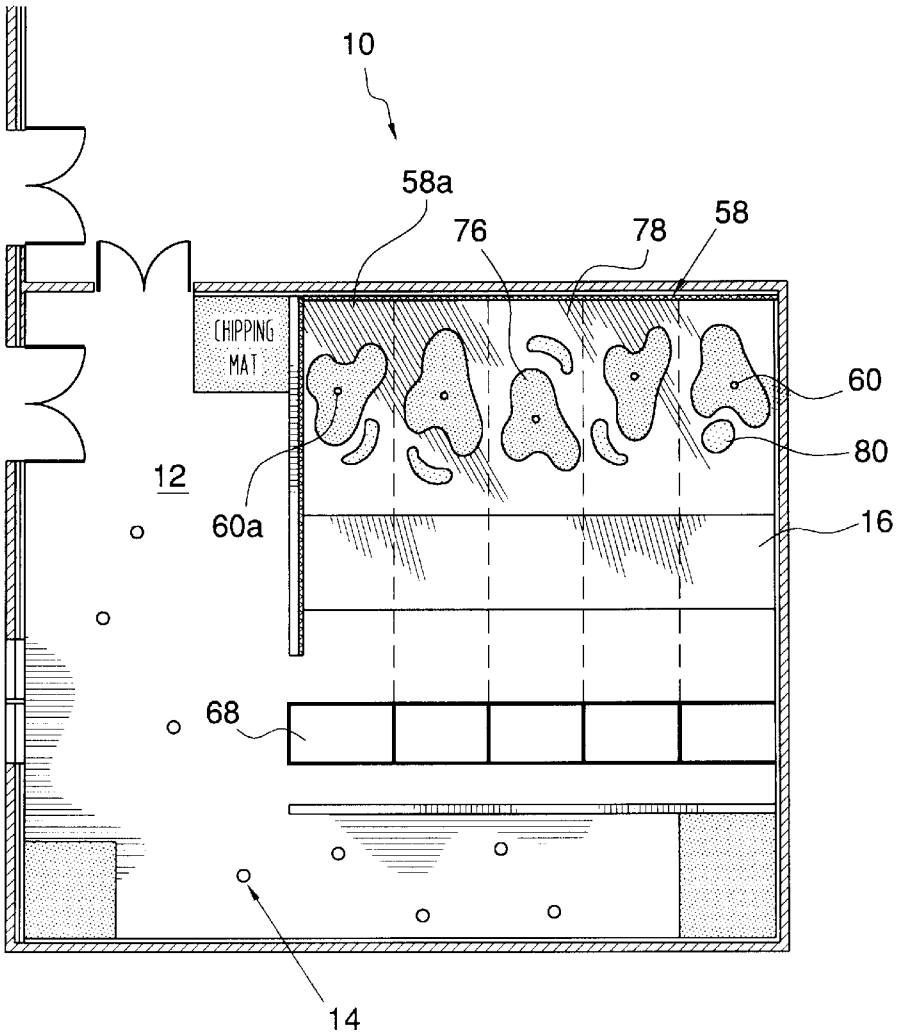
FIG. 1 is a schematic of the present educational golf facility.

With reference to FIG. 1, a multipurpose educational golf facility 10 is disclosed. The educational golf facility 10 is intended for use at schools, and other education facilities, by building the educational golf facility 10 within the school building or constructing a separate facility adjacent the school. While it is contemplated that the educational golf facility should be maintained at a fixed location, those skilled in the art will appreciate the possibility of constructing each of the training components discussed below as a portable structure which may be moved from location to location without substantial difficulty.

Figure 3:
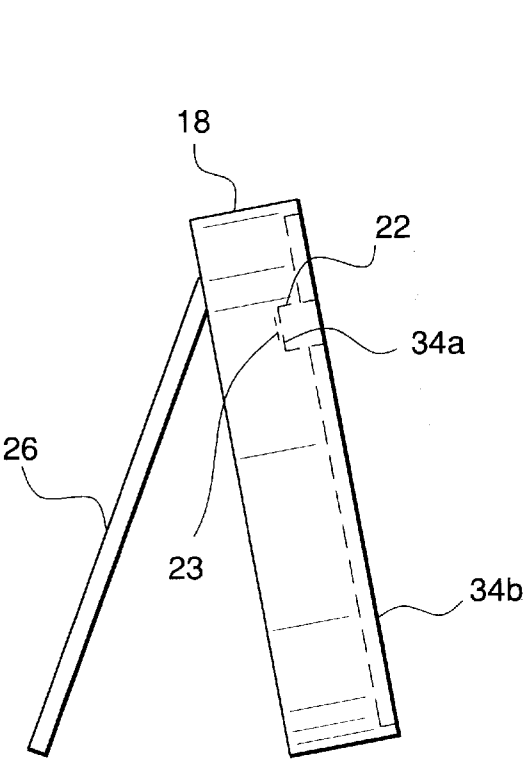
FIG. 3 is a side view of the portable textured target in accordance with the present invention.
Figure 2:
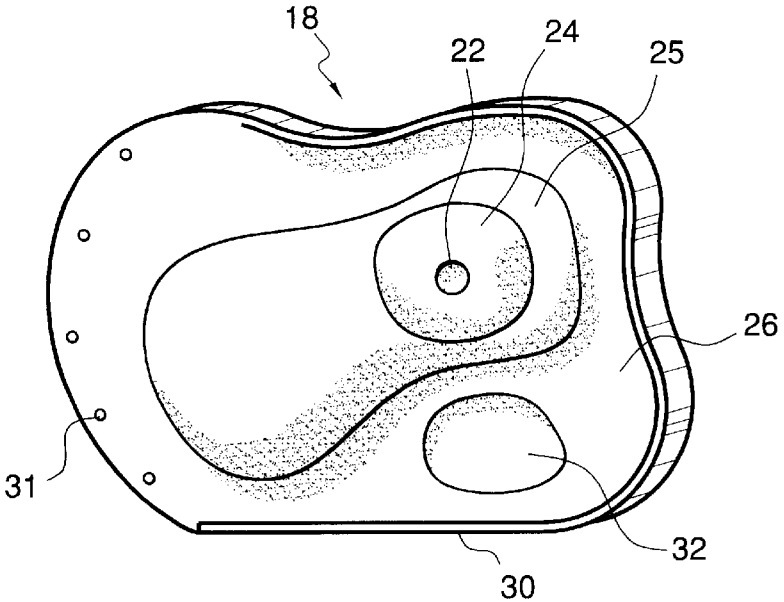
FIG. 2 is a perspective view of the portable textured target in accordance with the present invention.
Figure 2:
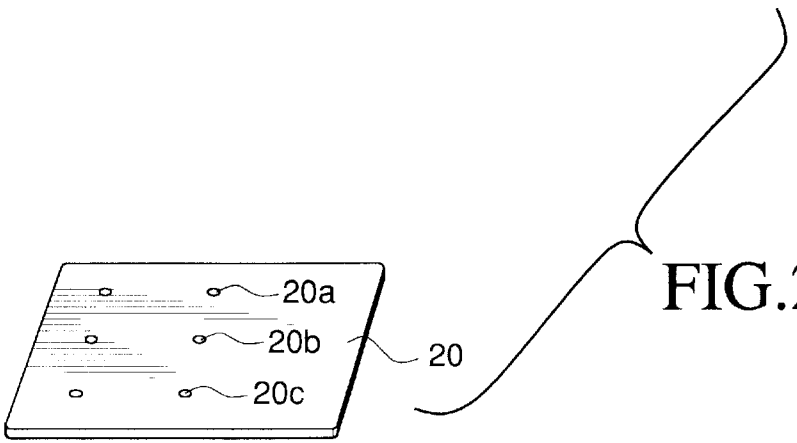

The educational golf facility 10 is generally composed of a target chipping zone 12, putting zone 14 and inclined chipping/putting lanes 16. With reference to FIGS. 2 and 3, the target chipping zone 12 generally includes a portable textured target 18 at which the student may chip a golf ball from a mat 20 in an effort to develop the skills necessary to effectively learn a "short game", that is, short distance shots generally performed in the vicinity of a golf green. The mat 20 is marked with tee markers 20*a*, 20*b*, 20*c* similar to those found upon a conventional golf course. The portable textured target 18 is supported vertically by a leg 26 secured to the back thereof.

The portable textured target 18 includes a central hole 22, have a closed end wall 23, into which a student attempts to chip a golf ball. The central hole 22 is preferably 4 inches, although those skilled in the art will appreciate the various hole sizes which may be used based upon the skill level of the students using the portable textured target 18. Immediately surrounding the central hole 22 is a first ring 24 immediately surrounding the hole section and a first section 25 replicating a putting green. A second section 26 replicating the fringe around a putting green surrounds the first section 25. The second section 26 may be provided with a water hazard boundary 30, out of bounds stakes 31 and sand traps 32 to lend an element of the reality to the portable textured target 18.

Use of the portable textured target 18 is facilitated by covering the closed end wall 23 of the hole 22, the first ring 24, the first section 25 and the second section 26 with Velcro, hook and loop, fastening material 34*a*, 34*b* and using a golf ball provided with a surface adapted to "stick" to the Velcro surface. In this way, the chipped ball will stick to the portable textured target 18 allowing students to readily determine the position at which it struck the portable textured target 18.

In addition to the physical training provided by the present portable textured target 18, students learn the scoring elements of golf by using the portable textured target 18 in conjunction with a scoring system and score sheet 36 (see FIG. 4). Specifically, students are provided with a score sheet 36 on which to keep score as they chip at the portable textured target 18. Before beginning use of the portable textured target 18, students are taught (with reference to the chart shown in FIG. 5) that an eagle means two under par, a birdie means one under par, a par indicates a score allotted for the hole, a bogey indicates a score of one over par, and a double bogey indicates a score of two over par. Students are then instructed that chipping the ball into the hole 22 is an eagle, chipping the ball so it sticks to within the first ring 24 is a birdie, chipping the ball so it sticks within the first section 25 scores a par, chipping the ball so it sticks to the second section (including the sand trap 32) 26 scores a bogey and missing the target 18 entirely scores a double bogey.

Armed with this information, students use the portable textured target 18 while marking their score each time they chip. For example, and with reference to FIGS. 4 and 5, if Sue chips it through the hole 22 the first time, an eagle would be scored on the first hole; that is, since the first hole is a par four, the student would be required to write a two with the eagle symbol indicating that an eagle had been scored on the hole. Scoring proceeds in a similar manner for as many "holes" as the students are required to "play".

Figure 10:
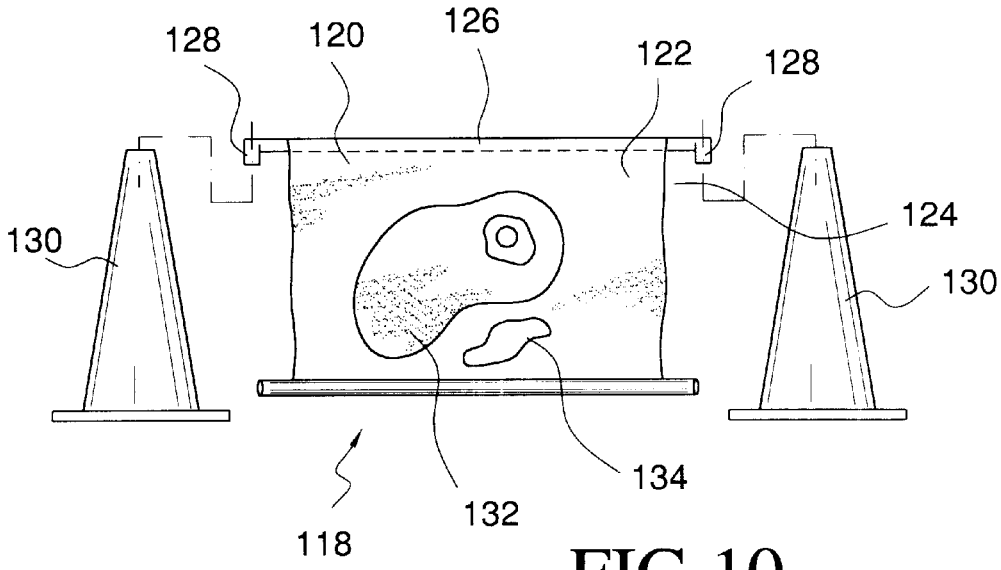
FIG. 10 is an alternate embodiment of a target in accordance with the present invention.

An alternate embodiment of a portable textured target 118 is disclosed in FIG. 10. This alternate embodiment is generally composed of a flexible sheet 120 of material having a Velcro, hook and loop type, material on a contact side 122 thereof. The material of the flexible sheet 120 may be either the hook or loop type material so long as the ball used in conjunction with the disclosed portable textured target cooperates with the chosen material to "stick" thereto when struck by a student.

The upper end 124 of the portable textured target 118 includes a relatively stiff support member 126 with end tabs 128 secured to opposite ends thereof. The end tabs 128 are shaped and dimensioned for positioning within the top portion of conventional cones 130. In this way, the portable textured target 118 may be readily unrolled, secured across a pair of cones 130, utilized by students and conveniently returned to a storage room after the class is over.

The portable textured target 118 is provided with a putting green design 132 with associated hazards, for example, a sand trap 134. As such, student using the present portable textured target keep score in the same manner described above with reference to FIGS. 2 and 3.

Figure 6:
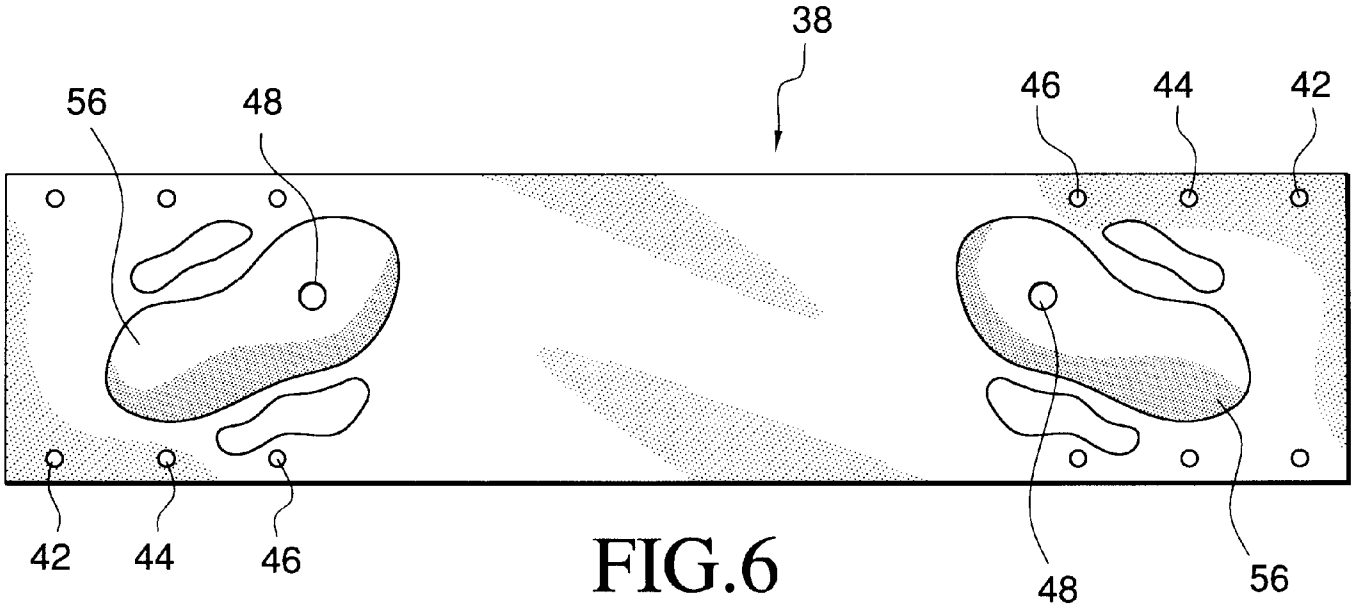
FIG. 6 is a top view of the putting zone in accordance with the present invention.
Figure 7:
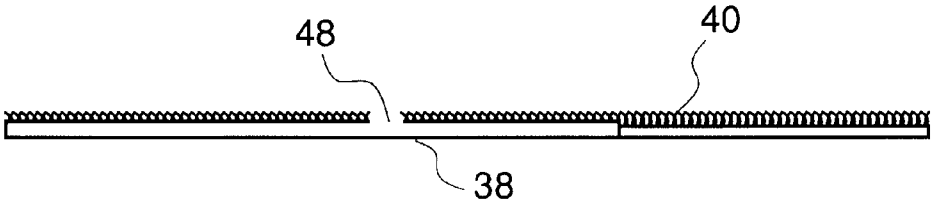
FIG. 7 is a side view of a putting surface in accordance with present invention.

As mentioned above, the present educational golf facility 10 is further provide with a putting zone 14. The putting zone 14 generally consists of putting carpet 38 formed of synthetic grass 40 having various golf elements and indicia formed thereon. These elements and indicia are repeated on opposite ends of the putting carpet 38. With reference to FIGS. 6 and 7, each end of the putting carpet 38 includes three tee markers 42, 44, 46 and a hole 48. These are indicative of tee markers commonly found on conventional golf courses and generally relate to the "Championship Tees" 42, "Traditional Tees" 44, and "Women's Tees" 46.

Using these indicia, students practice putting while also learning the rules and traditions of golf. For example, the students first decide whether they will be playing from the "Championship Tees" 42, "Traditional Tees" 44, and "Women's Tees" 46. Once they begin putting, scoring is performed in much the same manner as discussed above with regard to the target chipping zone 12. A birdie is awarded where the ball comes to rest in the hole 48, a par is awarded where the ball comes to rest within the putting green boundary 56 (a ball touching a part of the putting green boundary 56 is considered to be a par), a bogey is awarded where the ball comes to rest any place on the putting carpet 38 surface outside of the putting green boundary 56 and a double bogey is awarded if the ball rolls off the putting carpet 38 surface.

Controlled putting is further enhanced by providing a putting hole 48 have a defined depth. The defined depth is intended to teach students that putts should be struck with a speed such that they will pass approximately 15 inches past the hole 48. If a ball reaches the hole at such a speed, the ball will stop within the hole 48. If, however, the ball is moving faster than desired, the ball will pass through the hole 48 and come to rest somewhere behind the hole 48. In accordance with a preferred embodiment of the present invention, the hole 48 is formed with a depth of approximately ½ inch.

As with the target chipping zone 12, the putting zone 14 provides students with an opportunity to develop their physical skills while also learning the rules of golf.

Figure 8A:
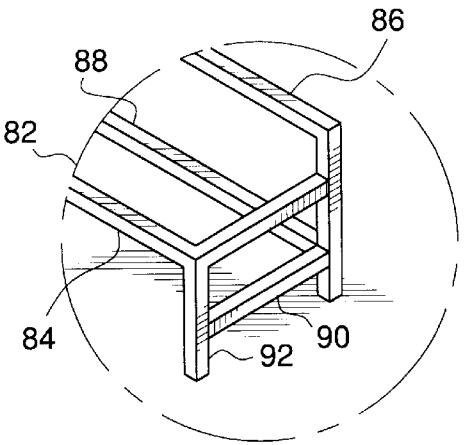
FIG. 8*a* is a detailed view of the enclosure used in conjunction with the chipping/putting lanes.
Figure 8:
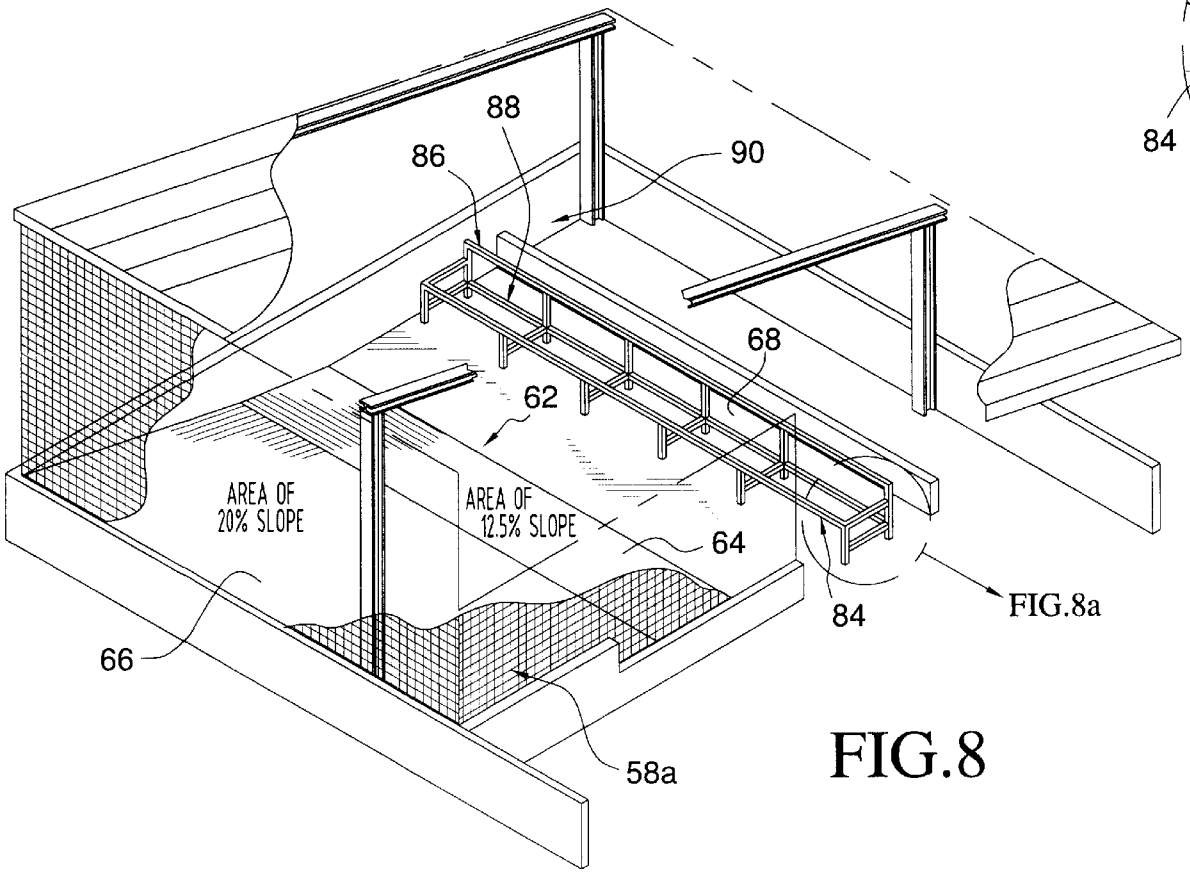
FIG. 8 is a perspective view of the chipping/putting lanes.

Further to the putting zone 14 and the target chipping zone 12, the present educational golf facility is provided with chipping/putting lanes 16. Referring to FIGS. 1, 8 and 8*a*, the chipping/putting lanes 16 generally include a plurality of lanes 58 offering the student the chance to chip or putt at a hole 60.

With reference to the first lane 58*a*, (all the lanes 58 are substantially the same in their general physical makeup, although they may be aesthetically varied to offer different challenges to the students), the participating student faces an inclined surface 62 up which he or she is instructed to hit the golf ball at a target or hole 60. In accordance with a preferred embodiment of the present invention, the inclined surface 62 is two tiered and includes a lower first tier 64 inclined at a slope of approximately a 12.5 degrees and an upper second tier 66 inclined at a slope of approximately 20 degrees. While a specific incline construction is proposed for use in accordance with the present invention, other incline structures may be used without departing from the spirit of the present invention.

With this in mind, the student may choose to pitch or putt the ball toward the hole 60*a* outlined at the upper end of the lane 58*a*. Since the lane 58*a* is inclined up from the hitting area 68, all balls struck toward the hole 60*a* will roll back to the participating student.

Figure 9:
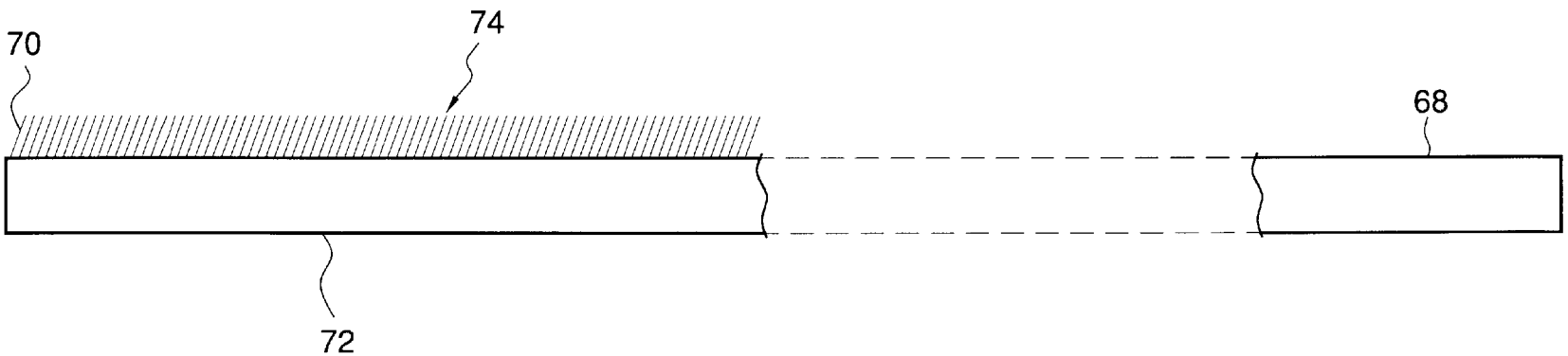
FIG. 9 is a cross sectional view of the turf used with the chipping putting lanes.

The return of struck balls, especially when the student is chipping, is ensured by constructing the lanes 58 of long stranded 70 artificial turf 72 with the grain 74 of the turf 72 directed toward the student (see FIG. 9). For example, and in accordance with the present invention, the turf is composed of polypropylene strands having a length of approximately 1.0 to 2.5 inches. In this way, the turf 72 "catches" the ball as it lands upon the inclined surface 62 and acts as bite or backspin. This prevents the ball from freely rolling to the top of the inclined surface 62 and permits the student to better determine where the ball is landing based upon the strength of his or her shot.

As with the putting zone 14 and target chipping zone 12, the student is told to keep score based upon a set of instructions relating to the landing point of the struck ball. For example, a ball striking the inner circle 60 will be awarded a birdie, a ball striking the marked "putting green" 76 will be awarded a par, a ball striking outside of the "putting green" 78 will be awarded a bogey, and a ball striking the water 80 or out of the lane 58 will be awarded a double bogey.

The safety of the students participating around the chipping/putting lanes is ensured by providing a safety area 68 in front of which the student stands as he or she uses the chipping/putting lanes 16. The safety area 68 is defined by an enclosure 82 consisting of a forward horizontal bar 84, upper and lower rear horizontal bars 86, 88, lateral and vertical support bars 90, 92. The arrangement of these bars prevents the student from over-swinging and striking another student. In addition, the defined striking area limits other students' access to the area immediately surrounding the student striking the golf balls, and creates a safety zone 90.

In addition to providing for the safety of the students using the present educational golf facility 10, the forward horizontal bar 84 acts to respectively control the back swing of students practicing at the chipping/putting lanes 16. By preferably providing the horizontal bar 84 at a height of approximately 36 inches, students are taught a proper chipping technique that prevents over swinging.

Figure 11:
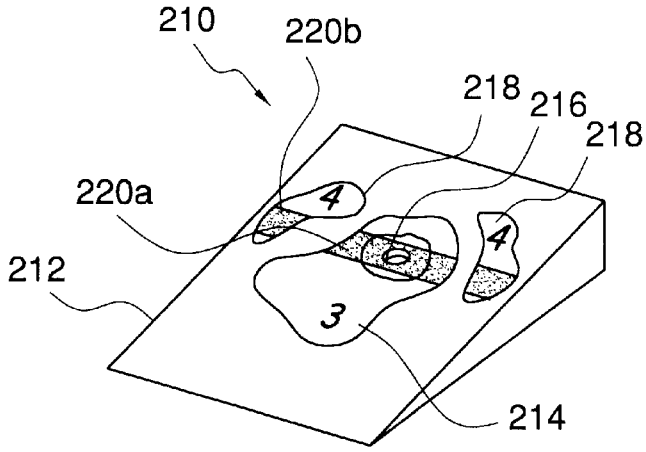
FIG. 11 is an alternate embodiment of a ramp type educational device in accordance with the present invention.

A further educational device which may be used by younger children (for example, kindergarten through $2^{rd}$ grade) as a replacement for the ramp disclosed in FIGS. 1, 8 and 8*a*, is disclosed in FIG. 11. This device allows younger children to either roll (by hand) or putt a ball toward a smaller scale target. The ramp 210 disclosed in FIG. 11 generally includes a ramped support surface 212 with designs relating to a green 214, hole 216 (preferably formed in the ramp) and sand traps 218 imprinted thereon. The support surface 212 is provided with Velcro, hook and loop type, material 220*a*, 220*b* at predetermined locations thereon. The material used may be either the hook or loop type material, so long as the ball used in conjunction with the disclosed ramp cooperates with the chosen material to "stick" thereto when struck by a club or rolled by hand.

In accordance with a preferred embodiment of the present invention, the Velcro material is secured at locations in line with the hole 220*a* and in the sand trap 220*b*. In this way, the ball will stick in these areas allowing a student to easily determine the points which should be scored. With this in mind, students putt or roll balls up the ramp, determine where the balls stop and are instructed to keep score in much the same manner as with the prior devices discussed in accordance with the present invention.

With the foregoing in mind, the present educational golf facility offers students the opportunity to both physically and mentally learn the game of golf in a controlled, student friendly environment. Students learn effective techniques for striking a golf ball, while simultaneously learning the scoring system and many of the rules integrally associated with the game of golf.

In addition, students are instructed to move around the educational golf facility in "foursomes" so as to teach another element of the game of golf. Students are also taught courtesy; for example, be considerate of other golfers by not talking, moving or standing near players as they hit, be careful, be ready when it is your turn and remember playing take turns in an orderly manner.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A chipping/putting facility, comprising:

an extended surface including a striking area in front of which a student may swing a golf club and strike a golf ball and a surface extending from the striking area;

the surface is composed of long strand artificial turf with a grain facing the striking area, the turf acting to catch a ball as it lands upon the surface.

2. The chipping/putting facility according to claim 1, further including a plurality of lanes at which multiple students may strike golf balls up the surface, wherein each lane includes a striking area and a target positioned upon the surface.

3. The chipping/putting facility according to claim 1, wherein the striking area includes an enclosure protecting students in the vicinity of the striking area.

4. The chipping/putting facility according to claim 3, wherein the enclosure includes a forward horizontal bar and a rear horizontal bar.

5. The chipping/putting facility according to claim 4, wherein the forward horizontal bar is positioned to control the permissible back swing of a student utilizing the chipping/putting facility and the rear horizontal bar is positioned to keep other students from getting too close to those students using the chipping putting facility.

6. A chipping/putting facility; comprising:

an extended surface including a striking area in front of which a student may swing a golf club and strike a golf ball and an inclined surface extending from the striking area;

the inclined surface being oriented such that balls struck up the inclined surface return to the student standing in the striking area;

wherein the inclined surface is composed of long strand artificial turf with a grain facing the striking area, the turf acting to catch a ball as it lands upon the inclined surface.

7. The chipping/putting facility according to claim 6, further including a plurality of lanes at which multiple students may strike golf balls up the inclined surface, wherein each lane includes a striking area and a target position upon the inclined surface.

8. The chipping/putting facility according to claim 6, wherein the striking area includes an enclosure protecting students in the vicinity of the striking area.

9. The chipping/putting facility according to claim 8, wherein the enclosure includes a forward horizontal bar and a rear horizontal bar.

10. The chipping/putting facility according to claim 9, wherein the forward horizontal bar is positioned to control the permissible back swing of a student utilizing the chipping/putting facility and the rear horizontal bar is positioned to keep other students from getting too close to those students using the chipping putting facility.

11. A chipping/putting facility, comprising:

an extended surface including a striking area in front of which a student may swing a golf club and strike a golf ball and a landing surface extending from the striking area;

the striking area adjacent to an enclosure protecting students in the vicinity of the striking area, the enclosure including a forward horizontal bar and a rear horizontal bar connected by at least one lateral support bar so as to form a unitary enclosure, wherein the forward horizontal bar is positioned adjacent the striking area with the striking area between the forward horizontal bar and the landing surface, the forward horizontal bar being so positioned relative the striking area to control the permissible back swing of a student utilizing the chipping/putting facility; and the rear horizontal bar is positioned remote from the striking area with the forward horizontal bar located between the rear horizontal bar and the striking area so as to define a safety zone between the forward horizontal bar and the rear horizontal bar wherein the rear horizontal bar, in combination with the safety zone, function to keep other students from getting too close to those students using the chipping/putting facility.

12. The chipping/putting facility according to claim 11, wherein the forward horizontal bar is positioned approximately 36 inches high.

13. The chipping/putting facility according to claim 11, further including an upper rear horizontal bar positioned above the rear horizontal bar for protecting individuals in the vicinity of the facility.

14. A system for teaching students the game of golf, comprising:

a plurality of stations where students may perform different golf shots, the plurality of stations including a target chipping zone, at least one inclined chipping/putting lane, the inclined chipping putting lane including an extended surface including a striking area in front of which a student may swing a golf club and strike a golf ball and an inclined surface extending from the striking area; the inclined surface being oriented such that balls struck up the inclined surface return to the student standing in the striking area and a putting zone;

each station including targets associated with preassigned scores directly related to traditional scoring techniques used in the game of golf; and score cards upon which student write scores awarded as they participate at the plurality of stations;

wherein the targets are associated with scores of eagle, birdie, par and bogey determined based upon a single shot at the target, the score being subsequently be converted to a numerical score when written on the core card.

15. The system according to claim 14, wherein the putting zone includes at least one hole toward which students will putt a ball, the hole being of a depth of approximately ½ inch such that a ball having a desired speed will stop within the hole and a ball having a speed greater than the desired speed will roll through the hole.

* * * * *